US011762409B2

(12) United States Patent
Hsu et al.

(10) Patent No.: US 11,762,409 B2
(45) Date of Patent: Sep. 19, 2023

(54) VOLTAGE REGULATOR

(71) Applicant: ALi Corporation, Hsinchu (TW)

(72) Inventors: Chih-Yuan Hsu, Taipei (TW); Andrew Yang Lee, Taipei (TW)

(73) Assignee: ALi Corporation, Hsinchu (TW)

( * ) Notice: Subject to any disclaimer, the term of this patent is extended or adjusted under 35 U.S.C. 154(b) by 116 days.

(21) Appl. No.: 17/493,855

(22) Filed: Oct. 5, 2021

(65) Prior Publication Data

US 2022/0147085 A1 May 12, 2022

(30) Foreign Application Priority Data

Nov. 9, 2020 (CN) ..... 202011237178.X

(51) Int. Cl.
*G05F 1/575* (2006.01)

(52) U.S. Cl.
CPC ..... *G05F 1/575* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 5,689,460 A * 11/1997 Ooishi ..... G11C 5/143 327/535
7,619,402 B1 * 11/2009 Kwong ..... G05F 1/575 323/369
8,018,214 B2 * 9/2011 Kwon ..... G05F 1/565 323/901
9,459,641 B2 * 10/2016 Sakaguchi ..... G05F 1/5735
9,667,240 B2 * 5/2017 Moscaluk ..... H03K 17/223
9,766,643 B1 * 9/2017 Cai ..... G05F 1/575
9,915,963 B1 * 3/2018 Wu ..... G05F 1/575
10,128,865 B1 * 11/2018 Yang ..... H03M 1/682
10,216,209 B1 * 2/2019 Ham ..... G05F 1/575
10,496,115 B2 * 12/2019 Hung ..... G05F 1/462
10,860,043 B2 * 12/2020 Hung ..... G05F 1/565
10,996,700 B1 * 5/2021 Tan ..... G05F 1/575
11,314,267 B2 * 4/2022 Wang ..... G05F 1/575
(Continued)

FOREIGN PATENT DOCUMENTS

DE 102008012392 A1 * 9/2009 ..... G05F 1/56

*Primary Examiner* — Thienvu V Tran
*Assistant Examiner* — Nusrat Quddus
(74) *Attorney, Agent, or Firm* — JCIPRNET

(57) ABSTRACT

The disclosure provides a voltage regulator with a soft-start effect. The voltage regulator includes an amplifier, a first voltage setting circuit, a voltage selector and a power transistor. The amplifier has two input terminals to receive respectively a reference voltage and a feedback voltage. The amplifier has a current source to provide a current to an output terminal. In a voltage bypass mode, the first voltage setting circuit increases a driving voltage on the output terminal according to the current based on a selection voltage. In the voltage bypass mode, the voltage selector sequentially reduces the selection voltage respectively in multiple time intervals in a startup time interval. The power transistor receives the driving voltage, and generates an output voltage according to the driving voltage based on an operating power supply.

10 Claims, 4 Drawing Sheets

(56) References Cited

U.S. PATENT DOCUMENTS 11,526,186 B2 * 12/2022 Chang ..... G05F 1/618
2003/0178980 A1 * 9/2003 Biagi ..... G05F 1/575 323/282
2006/0170401 A1 * 8/2006 Chen ..... G05F 1/569 323/273
2010/0156364 A1 * 6/2010 Cho ..... G05F 1/565 323/280
2010/0253299 A1 * 10/2010 Kim ..... G06F 1/26 323/282
2010/0289472 A1 * 11/2010 Renous ..... G05F 1/575 323/282
2013/0113447 A1 * 5/2013 Kadanka ..... G05F 1/563 323/280
2013/0119954 A1 * 5/2013 Lo ..... G05F 1/10 323/280
2013/0234688 A1 * 9/2013 Sakaguchi ..... H03H 11/1213 327/558
2013/0285630 A1 * 10/2013 Wang ..... G05F 1/562 323/275
2015/0077076 A1 * 3/2015 Bhattad ..... G05F 1/56 323/280
2015/0137781 A1 * 5/2015 Qu ..... G05F 1/56 323/280
2016/0116927 A1 * 4/2016 Chen ..... G05F 1/575 323/280
2016/0161961 A1 * 6/2016 El-Nozahi ..... G05F 1/56 323/280
2016/0240251 A1 * 8/2016 Shih ..... G11C 13/0038
2016/0291619 A1 * 10/2016 Guan ..... G05F 1/56
2017/0063223 A1 * 3/2017 Raghupathy ..... G05F 1/56
2017/0269623 A1 * 9/2017 Kumbaranthodiyil ..... G05F 3/185
2018/0046211 A1 * 2/2018 Vilas Boas ..... G05F 1/575
2019/0025861 A1 * 1/2019 Hung ..... G05F 1/465
2019/0146533 A1 * 5/2019 Cai ..... G05F 1/468 323/281
2019/0324484 A1 * 10/2019 Cheng ..... H03K 5/24
2021/0103308 A1 * 4/2021 Liu ..... G05F 1/563
2022/0011798 A1 * 1/2022 Matyscak ..... G05F 1/565
2022/0147080 A1 * 5/2022 Hsu ..... G05F 1/565
2022/0147084 A1 * 5/2022 Hsu ..... G05F 1/468
2022/0147085 A1 * 5/2022 Hsu ..... G05F 1/575
2022/0147086 A1 * 5/2022 Lee ..... G05F 1/468
2022/0382307 A1 * 12/2022 Tse ..... G05F 1/468
2023/0009027 A1 * 1/2023 Chen ..... G05F 1/595
2023/0185321 A1 * 6/2023 Balsom ..... G05F 1/575 323/280

* cited by examiner

VOLTAGE REGULATOR

CROSS-REFERENCE TO RELATED APPLICATION

This application claims the priority benefit of China application serial No. 202011237178.X, filed on Nov. 9, 2020. The entirety of the above-mentioned patent application is hereby incorporated by reference herein and made a part of this specification.

BACKGROUND

Technical Field

The disclosure relates to a voltage regulator, and in particular, to a voltage regulator with a soft-start function.

Description of Related Art

In the related art, a low drop-out voltage regulator needs to switch between a normal mode and a voltage bypass mode and generate an output voltage substantially equal to an operating power supply in the voltage bypass mode. In order to achieve such an effect, in the related art, an analog-digital conversion circuit is disposed to detect the level of the output voltage to correspondingly adjust the output voltage to a required level. In addition, in the voltage bypass mode, the voltage regulator may experience an instantaneous large current due to the rapidly rising output voltage. To avoid this phenomenon, it is necessary to dispose a high-performance soft-start mechanism in the voltage regulator in the voltage bypass mode.

SUMMARY

The disclosure is directed to a voltage regulator that may perform a soft-start operation in a voltage bypass mode.

According to an embodiment of the disclosure, the voltage regulator includes an amplifier, a first voltage setting circuit, a voltage selector, and a power transistor. The amplifier has two input terminals to receive respectively a reference voltage and a feedback voltage. The amplifier has a current source, and the current source is coupled between an operating power supply and an output terminal of the amplifier and provides a current to the output terminal. The first voltage setting circuit is coupled between the output terminal of the amplifier and a selection voltage, and increases a driving voltage on the output terminal according to the current based on the selection voltage in the voltage bypass mode. In the voltage bypass mode, the voltage selector sequentially reduces the selection voltage respectively in multiple time intervals in a startup time interval. The power transistor receives the driving voltage, and generates an output voltage according to the driving voltage based on the operating power supply.

According to the above, the voltage regulator according to the embodiment of the disclosure provides the voltage selector to time-divisionally reduce the provided selection voltage in the startup time interval in the voltage bypass mode. In this way, the voltage setting circuit may adjust the driving voltage stepwise, and the output voltage generated by the power transistor may be increased stepwise.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
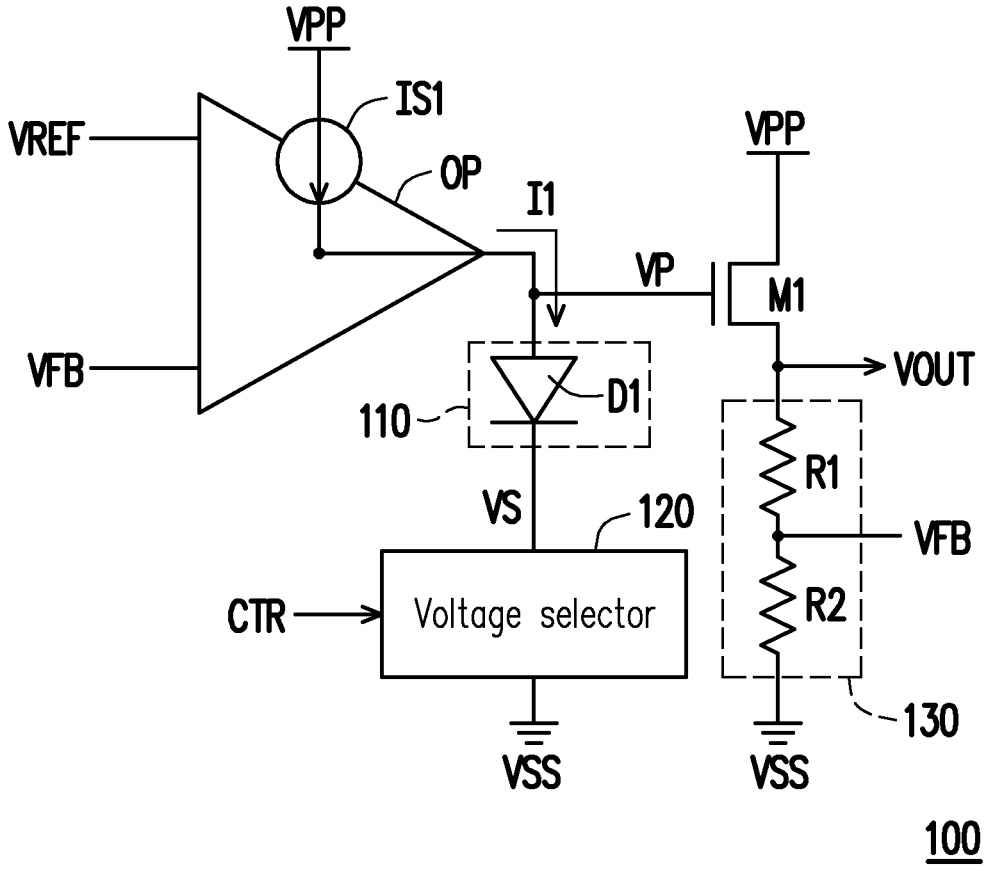
FIG. 1 is a schematic diagram of a voltage regulator according to an embodiment of the disclosure.

Reference will now be made in detail to the exemplary embodiments of the disclosure, and examples of the exemplary embodiments are illustrated in the accompanying drawings. Whenever possible, the same component symbols are used in the drawings and descriptions to indicate the same or similar parts.

Referring to FIG. 1, FIG. 1 is a schematic diagram of a voltage regulator according to an embodiment of the disclosure. A voltage regulator 100 includes an amplifier OP, a voltage setting circuit 110, a voltage selector 120, a feedback circuit 130, and a power transistor M1. The voltage regulator 100 may operate in a normal mode or a voltage bypass mode. When the voltage regulator 100 is in the normal mode, the voltage regulator 100 is configured as a low drop-out (LDO) voltage regulator and generates an output voltage VOUT lower than an operating power supply VPP according to a reference voltage VREF. When the voltage regulator 100 is in the voltage bypass mode, the voltage regulator 100 is configured to generate an output voltage VOUT that is substantially equal to the operating power supply VPP.

In this embodiment, the amplifier OP has two input terminals to receive respectively the reference voltage VREF and a feedback voltage VFB. For example, a positive input terminal of the amplifier OP may be configured to receive the reference voltage VREF, and a negative input terminal of the amplifier OP may be configured to receive the feedback voltage VFB. An output terminal of the amplifier OP is configured to provide a driving voltage VP. There is a current source IS1 in the amplifier OP. The current source IS1 receives the operating power supply VPP and is coupled to the output terminal of the amplifier OP. The current source IS1 may be configured to provide a current I1 to pull up the driving voltage VP generated by the output terminal of the amplifier OP.

One terminal of the voltage setting circuit 110 is coupled to the output terminal of the amplifier OP, and another terminal of the voltage setting circuit 110 receives a selection voltage VS. The voltage setting circuit 110 is turned on in the voltage bypass mode. By receiving the current I1 generated by the current source IS1, the voltage setting circuit 110 pulls down the driving voltage VP on the output terminal of the amplifier OP based on the selection voltage VS received by a second terminal of the voltage setting circuit 110. By pulling down the driving voltage VP, the P-type power transistor M1 may generate an output voltage VOUT that is substantially equal to the operating power supply VPP.

In this embodiment, the voltage setting circuit 110 includes a diode D1. An anode of the diode D1 is coupled to the output terminal of the amplifier OP, and a cathode of the diode D1 is coupled to a terminal of the voltage selector 120 providing the selection voltage VS. In the voltage bypass mode, the diode D1 may receive the current I1 provided by the current source IS1, and pull down the level of the driving voltage VP on the output terminal of the amplifier OP.

The voltage selector 120 is coupled to the second terminal of the voltage setting circuit 110 to provide the above-mentioned selection voltage VS. It is noted that in the voltage bypass mode, the voltage selector 120 is turned on. Moreover, in multiple time intervals in a startup time interval when the voltage selector 120 is turned on, the voltage selector 120 may configure the selection voltage VS at multiple different levels. In multiple consecutive time intervals, the level of the selection voltage VS decreases sequentially. It is noted herein that the voltage selector 120 may also receive the current I1 provided by the current source IS1 and determine the level of the selection voltage VS according to the current I1.

By reducing the selection voltage stepwise, the driving voltage VP may be reduced stepwise, and the output voltage VOUT may be increased stepwise to reduce the instantaneous current change generated on the power transistor M1, so that a soft-start operation is achieved.

In this embodiment, the voltage selector 120 may adjust the level of the generated selection voltage VS according to a control signal CTR. On the other hand, when the voltage regulator 100 operates in the normal mode (non-voltage-bypass mode), the voltage selector 120 is turned off and is not operating. The turn-on/turn-off operations of the voltage selector 120 may also be executed according to the control signal CTR.

In addition, the feedback circuit 130 according to the embodiment of the disclosure includes a resistor R1 and a resistor R2 connected in series. The resistor R1 and the resistor R2 are sequentially connected in series between the terminal of the power transistor M1 generating the output voltage VOUT and a reference ground terminal VSS, and divide the output voltage VOUT to generate the feedback voltage VFB.

Figure 2A:
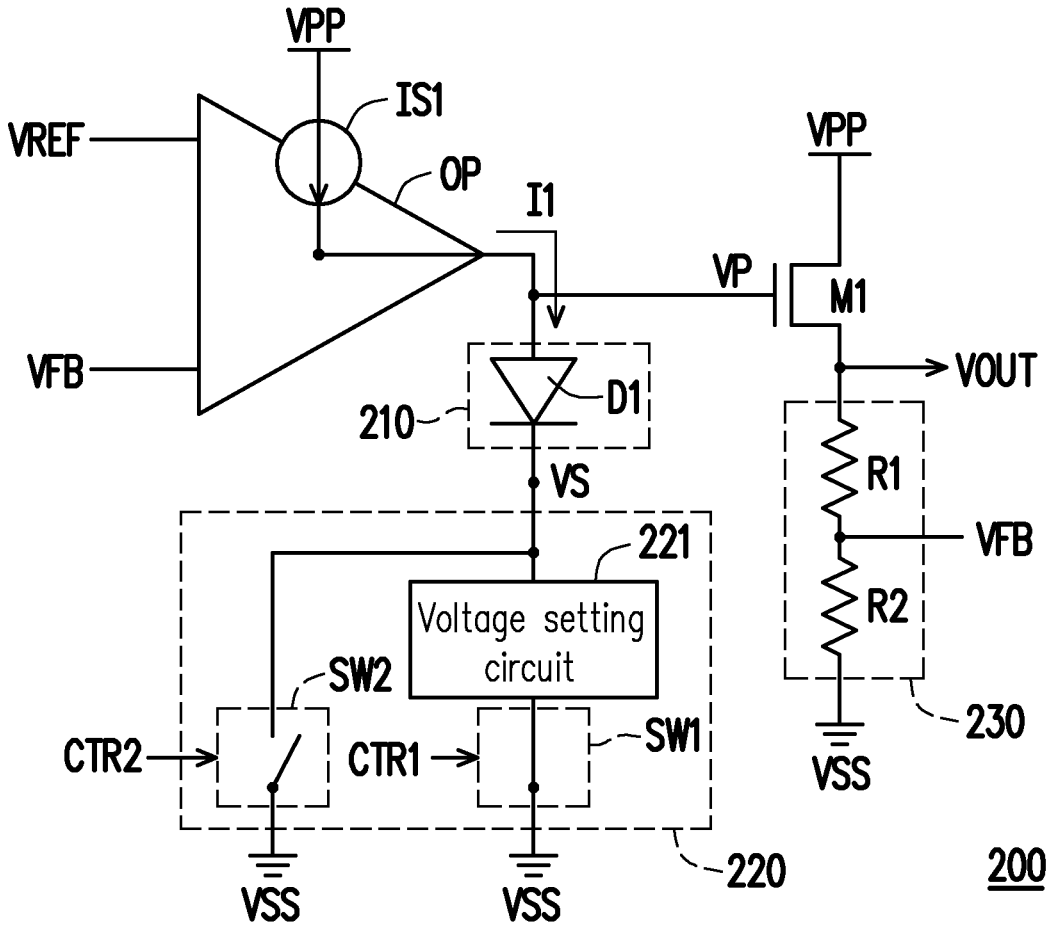
FIG. 2A and FIG. 2B are schematic diagrams respectively showing a voltage regulator and operations thereof according to another embodiment of the disclosure.
Figure 2B:
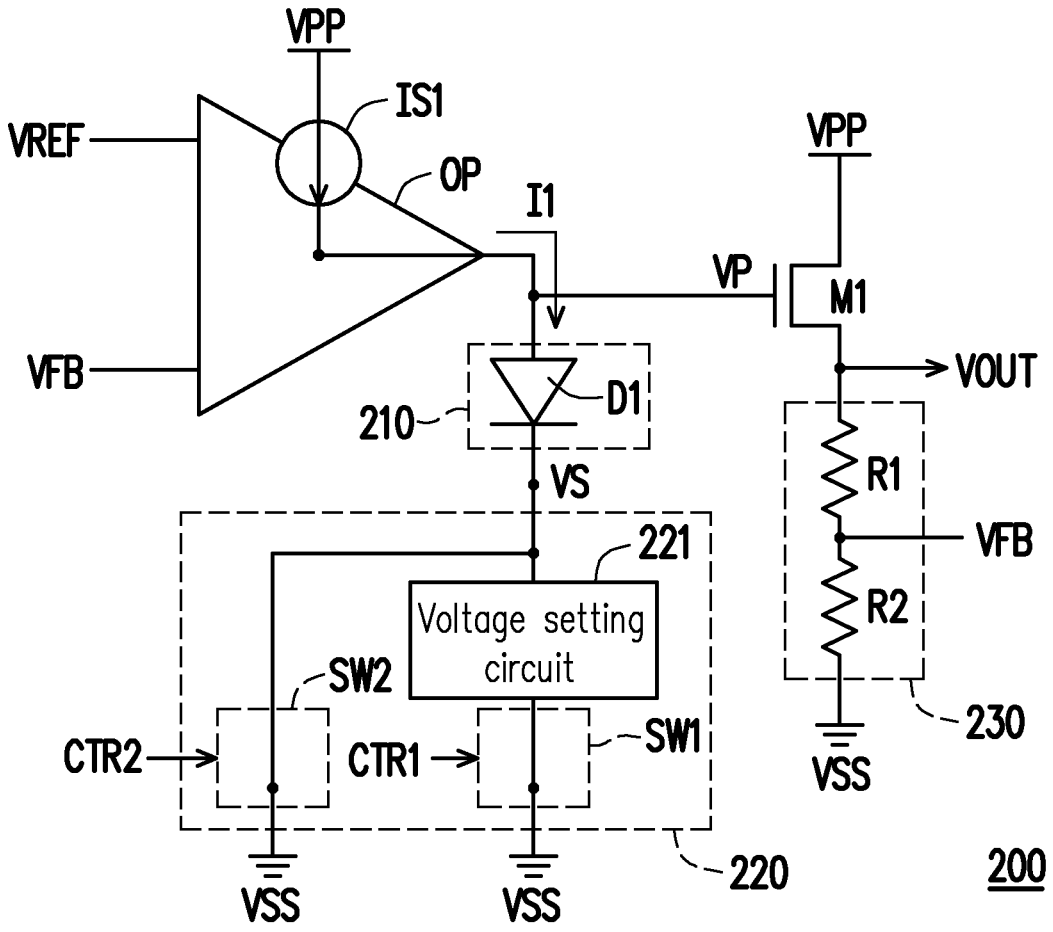

Referring to FIG. 2A and FIG. 2B next, FIG. 2A and FIG. 2B are schematic diagrams respectively showing a voltage regulator and operations thereof according to another embodiment of the disclosure. In FIG. 2A, a voltage regulator 200 includes an amplifier OP, a voltage setting circuit 210, a voltage selector 220, a feedback circuit 230, and a power transistor M1. The amplifier OP has a current source IS1 therein; the voltage setting circuit 210 includes a diode D1; and the feedback circuit 230 includes a resistor R1 and a resistor R2.

Different from the foregoing embodiment, in this embodiment, the voltage selector 220 includes a voltage setting circuit 221, a switch SW1, and a switch SW2. The voltage setting circuit 221 and the switch SW1 are connected in series and coupled between the cathode of the diode D1 and the reference ground terminal VSS. The switch SW2 is coupled between the cathode of the diode D1 and the reference ground terminal VSS, and is coupled in parallel with the voltage setting circuit 221 and the switch SW1 connected in series.

When the voltage regulator 200 is in the voltage bypass mode, the voltage selector 220 is turned on. In addition, in a first time interval in a startup time interval, the switch SW1 is turned on according to a control signal CTR1, and the switch SW2 is turned off according to a control signal CTR2. At this time, the voltage selector 220 receives the current I1. The voltage selector 220 provides a selection voltage VS to the cathode of the diode D1 according to the current I1. Based on the selection voltage VS, the diode D1 sets the driving voltage VP to be close to the selection voltage VS according to current I1. At this time, the selection voltage VS is greater than a reference ground voltage on the reference ground terminal VSS. In this way, the power transistor M1 may configure the output voltage VOUT to gradually increase from 0 volts to a first voltage lower than the operating power supply VPP.

Next, referring to FIG. 2B, after the output voltage VOUT remains stable at the first voltage lower than the operating power supply VPP, the voltage regulator 200 may enter a second time interval. In the second time interval, the switch SW2 may change to a turn-on state according to the control signal CTR2. At this time, the voltage selector 220 reduces the provided selection voltage VS to the reference ground voltage on the reference ground terminal VSS, and the voltage setting circuit 210 may set the driving voltage VP as the reference ground voltage on the reference ground terminal VSS. At this time, the power transistor M1 may be completely turned on, and the output voltage VOUT generated by the power transistor M1 may be raised to a level substantially equal to the operating power supply VPP.

It is noted herein that in the second time interval mentioned above, the power transistor M1 may still provide a relatively low resistance. Therefore, the output voltage VOUT and the operating power supply VPP may have a very low voltage difference. Therefore, in the second time interval in the voltage bypass mode, the output voltage VOUT may rise to be equal to the operating power supply VPP.

Figure 3:
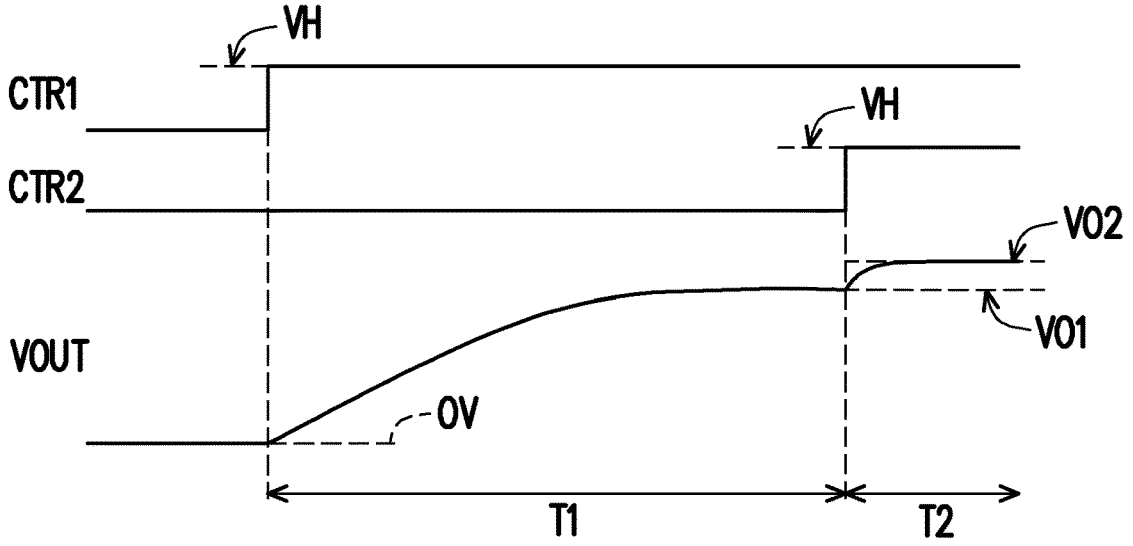
FIG. 3 shows an operation waveform schematic diagram according to the embodiment of FIG. 2A and FIG. 2B of the disclosure.

Refer to FIGS. 2A, 2B, and 3 simultaneously, FIG. 3 shows an operation waveform schematic diagram according to the embodiment in FIGS. 2A and 2B of the disclosure. In FIG. 3, in a first time interval T1 of the startup time interval in the voltage bypass mode, the control signal CTR1 is pulled up to a relatively high voltage VH. At this time, as shown in FIG. 2A, the switch SW1 is turned on (the switch SW2 remains turned off). The output voltage VOUT generated by the power transistor M1 is gradually pulled up from 0 volts to a first voltage VO1. Then, in a second time interval T2 after the output voltage VOUT is stably equal to the first voltage VO1, the control signal CTR2 is pulled up to the voltage VH. At this time, the switch SW2 also changes to the turn-on state (the switch SW1 remains turned on). The output voltage VOUT generated by the power transistor M1 is pulled up from the voltage VO1 to a voltage VO2. The voltage VO2 may be equal to the operating power supply VPP.

In the non-voltage-bypass mode, the switch SW1 and the switch SW2 are both turned off. At the same time, both the voltage selector 220 and the voltage setting circuit 210 stop operating. In other words, the driving voltage VP is not affected by the voltage selector 220 and the voltage setting circuit 210. At this time, the amplifier OP may adjust the level of the driving voltage VP according to a comparison of the reference voltage VREF and the feedback voltage VFB, and accordingly drive the power transistor M1 to generate the output voltage VOUT.

In addition, in the voltage bypass mode, the comparison operation of the reference voltage VREF and the feedback voltage VFB performed by the amplifier OP may be stopped to save power consumption.

Figure 4:
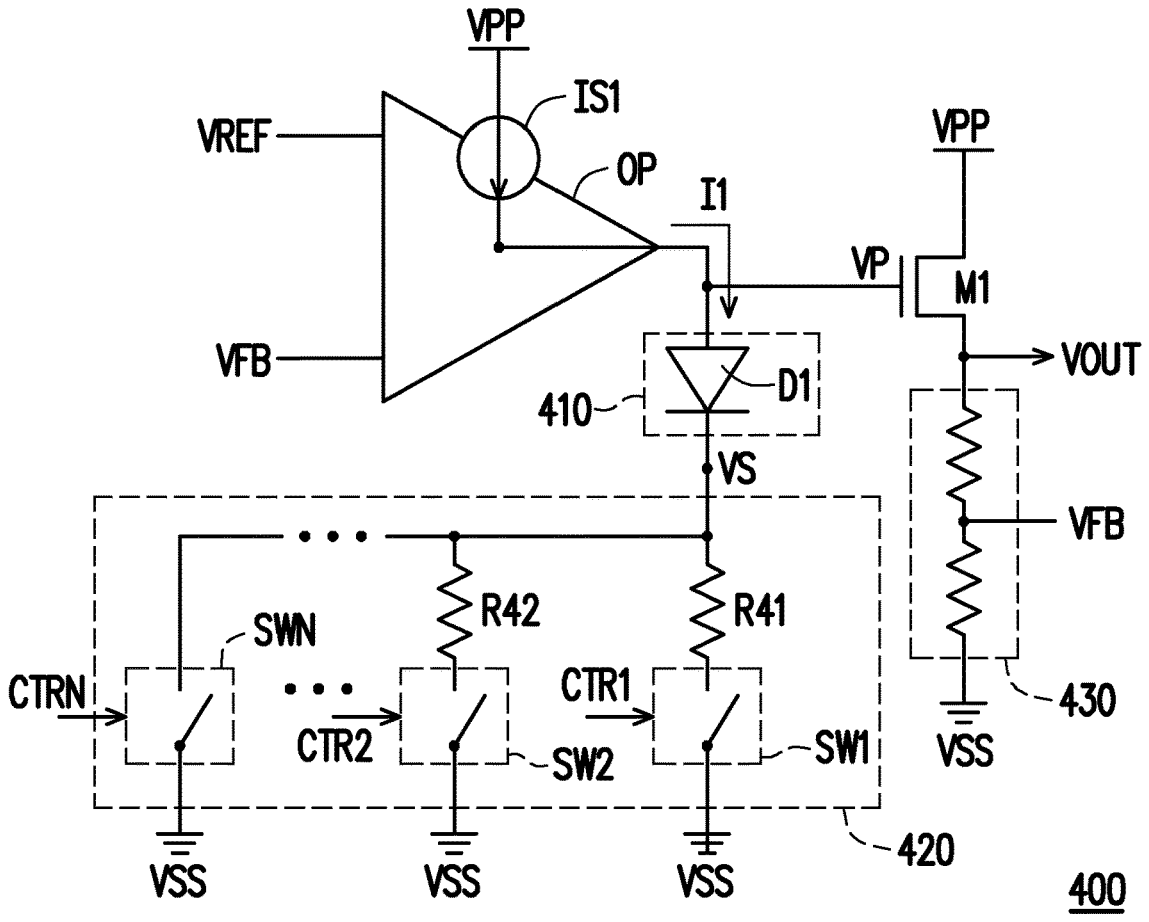
FIG. 4 is a schematic diagram of a voltage regulator according to another embodiment of the disclosure.

Referring to FIG. 4 next, FIG. 4 is a schematic diagram of a voltage regulator according to another embodiment of the disclosure. A voltage regulator 400 includes an amplifier OP, a voltage setting circuit 410, a voltage selector 420, a feedback circuit 430, and a power transistor M1. The amplifier OP has two input terminals to receive respectively a reference voltage VREF and a feedback voltage VFB. For example, the positive input terminal of the amplifier OP may be configured to receive the reference voltage VREF, and the negative input terminal of the amplifier OP may be configured to receive the feedback voltage VFB. The output terminal of the amplifier OP is configured to provide a driving voltage VP. There is a current source IS1 in the amplifier OP. The current source IS1 receives an operating power supply VPP and is coupled to the output terminal of the amplifier OP. The current source IS1 is configured to provide a current I1 to pull up the driving voltage VP generated by the output terminal of the amplifier OP. One terminal of the voltage setting circuit 410 is coupled to the output terminal of the amplifier OP, and another terminal of the voltage setting circuit 410 receives the selection voltage VS. The voltage setting circuit 410 is turned on in the voltage bypass mode. By receiving the current I1 generated by the current source IS1, the voltage setting circuit 410 pulls down the driving voltage VP on the output terminal of the amplifier OP based on the selection voltage VS received by a second terminal of the voltage setting circuit 110. By pulling down the driving voltage VP, the power transistor M1 may generate an output voltage VOUT that is substantially equal to the operating power supply VPP.

Different from the foregoing embodiment, the voltage selector 420 includes multiple voltage setting circuits respectively composed of a resistor R41 and a resistor R42, and includes multiple switches SW1 to SWN. The switches SW1 to SWN are controlled by control signals CTR1 to CTRN, respectively.

In terms of the operation details, before the voltage regulator 400 performs the voltage bypass mode, all the switches SW1 to SWN are turned off. When the voltage regulator 400 performs the voltage bypass mode, in a startup time interval, the switches SW1 to SWN may be turned on sequentially in multiple different time intervals. In such operation, the power transistor M1 may generate a gradually increased output voltage VOUT stepwise to achieve the soft-start effect.

It is noted that, in this embodiment, any circuit component such as diodes or transistors that may increase the voltage according to the received current I1 may be used as the voltage setting circuit in the voltage selector 420, and there are no specific restrictions. When a transistor is used to implement the voltage setting circuit in the voltage selector 420, the transistor may be coupled into a diode configuration, or the transistor may be biased in a linear region to become a resistor configuration. The relevant details are well known to those with ordinary skills in the art and will not be repeated herein.

According to the above description, in the voltage bypass mode, the voltage regulator according to the embodiment of the disclosure adjusts the driving voltage of the power transistor stepwise through the voltage selector cooperating with the voltage setting circuit. In this way, the output voltage generated by the power transistor may be increased stepwise, and the large current phenomenon caused by the rapid change of the output voltage level is mitigated, so that the soft-start effect is achieved.

Finally, it should be noted that the above embodiments are only used to illustrate, rather than limit, the technical solutions of the disclosure. Although the disclosure has been described in detail with reference to the foregoing embodiments, those of ordinary skill in the art should understand that they can still modify the technical solutions described in the foregoing embodiments, or equivalently replace some or all of the technical features. However, these modifications or replacements do not cause the essence of the corresponding technical solutions to deviate from the scope of the technical solutions of the embodiments of the disclosure.

What is claimed is:

1. A voltage regulator comprising:

an amplifier having two input terminals to receive respectively a reference voltage and a feedback voltage, wherein the amplifier has a current source, and the current source is coupled between an operating power supply and an output terminal of the amplifier and provides a current to the output terminal;

a first voltage setting circuit coupled between the output terminal and a selection voltage and increasing a driving voltage on the output terminal according to the current based on the selection voltage in a voltage bypass mode;

a voltage selector sequentially reducing the selection voltage respectively in a plurality of time intervals in a startup time interval in the voltage bypass mode; and a power transistor receiving the driving voltage and generating an output voltage according to the driving voltage based on the operating power supply, wherein, when the selection voltage is sequentially reduced in the time intervals, the driving voltage is sequentially reduced and the output voltage is sequentially increased in the time intervals.

2. The voltage regulator according to claim 1, wherein the voltage selector configures the selection voltage to be a first voltage according to the current in a first time interval in the startup time interval in the voltage bypass mode, and configures the selection voltage to be a reference ground voltage in a second time interval after the first time interval in the startup time interval, wherein the first voltage is greater than the reference ground voltage.

3. The voltage regulator according to claim 2, wherein the voltage selector comprises:

a second voltage setting circuit coupled between the first voltage setting circuit and the reference ground voltage;

a first switch coupled in series with the second voltage setting circuit between the first voltage setting circuit and the reference ground voltage; and a second switch connected in series between the first voltage setting circuit and the reference ground voltage.

4. The voltage regulator according to claim 3, wherein in the first time interval, the first switch is turned on and the second switch is turned off, and in the second time interval, both the first switch and the second switch are turned on.

5. The voltage regulator according to claim 3, wherein in a normal operating mode, both the first switch and the second switch are turned off.

6. The voltage regulator according to claim 3, wherein the second voltage setting circuit is a diode, a resistor or a transistor.

7. The voltage regulator according to claim 3, wherein the first switch and the second switch are transistor switches.

8. The voltage regulator according to claim 1, wherein the first voltage setting circuit is a diode, a resistor, or a transistor.

9. The voltage regulator according to claim 1, further comprising:

a feedback circuit coupled at a coupling path between the power transistor and a reference ground terminal, and dividing the output voltage to generate the feedback voltage.

10. The voltage regulator according to claim 1, wherein the voltage selector stops operating in a normal operating mode.

* * * * *